US005660172A

United States Patent [19]

Hatton

[11] Patent Number: 5,660,172

[45] Date of Patent: Aug. 26, 1997

[54] AUXILIARY BREATHING APPARATUS AND METHOD

[76] Inventor: Norman E. Hatton, 2197 Twilley Cir., Marietta, Ga. 30060

[21] Appl. No.: 532,090

[22] Filed: Sep. 22, 1995

[51] Int. Cl.[6] ..... A62B 9/02

[52] U.S. Cl. ..... 128/205.24; 128/201.28

[58] Field of Search ..... 128/201.27, 201.28, 128/204.26, 205.24

[56] References Cited

U.S. PATENT DOCUMENTS

| | | | |
|---|---|---|---|
| 439,093 | 10/1890 | Barian | 128/205.24 |
| 1,331,601 | 2/1920 | Watanabe | 128/205.24 |
| 2,152,110 | 3/1939 | Töpper | 128/201.28 |
| 2,484,044 | 10/1949 | Metzger | 128/201.27 |
| 2,485,908 | 10/1949 | Morrow | 128/200.29 |
| 2,810,387 | 10/1957 | Arpin et al. | 128/205.24 |
| 2,874,692 | 2/1959 | Galeazzi | 128/205.24 |
| 4,195,628 | 4/1980 | Lübitzsch et al. | 128/201.27 |
| 4,365,628 | 12/1982 | Hodel | 128/205.12 |
| 4,637,387 | 1/1987 | Hall | 128/205.24 |
| 4,823,786 | 4/1989 | Silber | 128/202.27 |
| 4,840,199 | 6/1989 | Brunt, Jr. | 128/205.24 |
| 5,099,835 | 3/1992 | Nekpka | 128/204.18 |
| 5,127,398 | 7/1992 | Stone | 128/204.18 |
| 5,275,153 | 1/1994 | Kay | 128/205.24 |
| 5,379,762 | 1/1995 | Kobayashi | 128/204.26 |

FOREIGN PATENT DOCUMENTS

| | | |
|---|---|---|
| 1222800 | 8/1966 | Germany . |
| 2102103 | 4/1990 | Japan . |

*Primary Examiner*—Aaron J. Lewis
*Attorney, Agent, or Firm*—R. Stevan Coursey

[57] ABSTRACT

An auxiliary breathing apparatus comprising, in accordance with a preferred embodiment, an interface assembly removably interposed and coupled between a compressed gas source and a mouthpiece. The interface assembly includes a pair of vertically-opposed actuators pivotally mounted relative to a valve remotely-located from the compressed gas source. The vertically-opposed actuators extend partially through the interface assembly and partially through the mouthpiece for receipt by a user's teeth. The remotely-located valve connects to a body portion having an insert which receives the remotely-located valve and places it into fluid communication with the compressed gas source. A valve actuator, residing within the insert and having a bore, depresses a valve stem of a source valve which extends partially into the insert at one end and partially into the compressed gas source at an opposite end. In accordance with a preferred method of the present invention, the vertically-opposed actuators enable a user to continually control the release of breathable gas from the remotely-located valve and, hence, the compressed gas source by the application of biting force to only one of the actuators. By varying the mount of biting force, the user continuously controls the quantity of breathable gas provided to the mouthpiece for inhalation by the user. The valve actuator and its bore, acting in cooperation with a plurality of bores defined by the insert, reduces the pressure and velocity of the breathable gas supplied by the compressed gas source to levels acceptable for human interface and consumption without employing a diaphragm-type regulator. Upon exhalation by the user, exhaust gases are directed from the mouthpiece and into the surrounding environment by a plurality of exhaust ports having exhaust flaps which flex away from the exhaust ports to "open" the exhaust ports and, thereby enable the release of the exhaust gases into the environment.

31 Claims, 11 Drawing Sheets

AUXILIARY BREATHING APPARATUS AND METHOD

BACKGROUND OF THE INVENTION

The present invention relates generally to the field of breathing systems and, in its most preferred embodiment, to the field of apparatus and methods for providing a temporary, portable supply of breathable gas.

Each year many people become trapped in burning buildings, trapped under shallow water, trapped under snow, or encounter a situation in which they either cannot breath at all because no air is available or cannot breath normally because the available air is fouled with smoke, chemical fumes, or other harmful airborne agents. Unfortunately, a number of these individuals suffocate and die tragically from an insufficient supply of oxygen to their brain. Other individuals die subsequently due to injuries to their lungs or brain caused by breathing unhealthy air. Still other individuals suffer life-long, chronic injuries to their lungs or brain caused by breathing smoke or inhaling toxic chemical fumes and not enough oxygen.

In many situations, death or serious injury could be avoided if the trapped victim had a readily accessible temporary (i.e., several minutes) supply of breathable gas available. Regrettably, many of today's temporary air supply devices include bulky air tanks, hoses, and masks and are simply too heavy and cumbersome to carry along, for instance, on kayaking or skiing runs. Furthermore, many victims need their hands free to aid in extricating themselves or cannot use their hands due to injury. As a result, many of today's temporary air supply devices are useless because their air supplies cannot be accessed without the use of the victim's hands. For example, white water kayakers are often flipped over in their boats and become stuck upside down under shallow water while racing down a stream. To turn his boat upright, the kayaker must have his hands free to manipulate his paddle or to push off of rocks and other stable objects and does not have his hands available to strap on a mask or turn on a valve as required by many air supply devices. In other situations, the killed or injured individual is a rescuer trying to extricate a victim who has become trapped or incapacitated. The rescuer may need only a few minutes of air to perform the rescue, but must have his hands free to safely remove the victim and cannot use his hands to initiate or continuously control the flow of air from a breathing device.

There is, therefore, a need in the industry for an apparatus and method which provides a temporary, "hands-free" supply of breathable gas to an individual and can solve other related and unrelated problems that become apparent upon reading and understanding this specification.

SUMMARY OF THE INVENTION

Briefly described, the present invention includes an auxiliary breathing apparatus and method which provides a user with a temporary supply of breathable gas on demand, while enabling "hands-free" access and control of the supply. More particularly, the present invention includes an auxiliary breathing apparatus and method which employs a unique interface assembly having an actuator operable by biting for continuous, remote control over the release of a gas from a connected compressed gas source.

In a preferred embodiment of the apparatus of the present invention, the interface assembly is removably interposed in fluid communication between a compressed gas cylinder and a mouthpiece which is received by a user's mouth. The interface assembly comprises a first actuator (also referred to herein as an upper internal actuator) which is pivotally mounted to a body at a position which enables it, with user manipulation, to actuate a valve remotely located from the compressed gas cylinder. The first actuator extends through portions of the interface assembly and mouthpiece for receipt and manipulation by a user's teeth and is biased toward a wall of the mouthpiece by a contacted biasing member which resides within a bore of the mouthpiece. Another actuator, referred to herein as an external actuator, extends through the wall of the mouthpiece and into contact with the upper internal actuator to enable alternate manipulation of the upper internal actuator. The interface assembly also includes a second actuator (also referred to herein as a lower internal actuator) which is pivotally mounted to the body and vertically-opposed to the first actuator. The second actuator, similar to the first actuator, extends through portions of the interface assembly and mouthpiece for receipt and manipulation by a user's teeth. The second actuator is positioned to enable contact with the first actuator, thereby causing the first actuator to operate the above mentioned valve upon user manipulation of the second actuator. The biasing member also contacts the second actuator and tends to push it toward the wall of the mouthpiece.

The interface assembly, in accordance with the preferred embodiment of the apparatus of the present invention, further comprises a novel insert which positions the above mentioned valve (also referred to herein as a first valve and also as a remote valve) distant from another valve (also referred to herein as a second valve and as a source valve) which is connected between the insert and the compressed gas source. The insert defines a plurality of bores which receive the valves and enable the gas to flow between the valves. A specially-designed valve actuator resides within a first bore above and in contact with the source valve to control the release of the gas from the compressed gas source. The valve actuator defines an internal passageway which, in cooperation with the bores, reduces the pressure and velocity of the gas released from the compressed gas source to levels acceptable for human inhalation without the use of conventional regulator-type mechanism. A pressure indicator connects to the body and depends partially into the insert's first bore. A rod portion of the pressure indicator extends from the body and provides a user with a visible indication of the amount of breathable gas available for future consumption.

In accordance with a preferred method of the present invention, a user determines and presets a maximum mount, or flow, of breathable gas which will be available upon subsequent operation of an actuator by positioning the valve actuator at a desired location relative to the source valve. The user then secures the auxiliary breathing apparatus relative to his body at a location where the mouthpiece is accessible to his mouth, without use of his hands, by mere bending of his neck and head. Thereafter, the user receives breathable gas on demand and at a desired quantity, or flow, (up to the preset maximum amount) by applying a biting force on either the upper or lower internal actuator to cause the upper internal actuator to pivot and depress a stem of the remote valve, thereby releasing breathable gas into a transfer chamber which is in fluid communication with the mouthpiece. The user continuously controls the amount of gas released (between the present maximum flow and no flow) by modifying the amount of biting force applied to an actuator and, hence, by controlling the amount of depression of the valve stem of the remote valve. Closure of the remote valve is assisted by the biasing member which tends to return the internal actuators to their "no-flow" positions (i.e., against the wall of the mouthpiece).

Upon release of breathable gas from the remote valve into the transfer chamber, the user, by attempting to breath, creates a suction which pulls the breathable gas from the transfer chamber and through the mouthpiece's bore. As the breathable gas passes through the mouthpiece's bore, it passes through a plurality of pores in the biasing member, thereby filtering the gas. Upon exhalation of exhaust gas by the user into the mouthpiece, the exhaust gas travels through the mouthpiece's bore and into the transfer chamber. The pressure created by the user's exhalation causes an exhaust flap to open and enable the exhaust gas to escape from the transfer chamber (and from the auxiliary breathing apparatus) via an exhaust port located beside the insert. When the user no longer requires breathable gas, the user simply releases the mouthpiece from his mouth.

In accordance with an alternate method of the present invention, a user, after presetting of the maximum gas flow, places the mouthpiece into the mouth of a second individual (for instance, during a revival or resuscitation attempt). Upon depression of an external actuator toward the wall of the mouthpiece, the upper internal actuator pivots and depresses the valve stem of the remote valve to release breathable gas into the transfer chamber for subsequent breathing by the second individual. The user continuously controls the amount, or flow, of breathable gas supplied to the second individual by varying the extent of depression of the external actuator. Upon release of the external actuator, the biasing member returns the internal actuators to their "no-flow" positions.

Accordingly, an object of the present invention is to supply a user with a flow of breathable gas which the user continuously controls by the application of biting force.

Another object of the present invention is to enable a user to receive breathable gas by using only his mouth to grasp and control the release of the air from an apparatus.

Still another object of the present invention is to enable a user to remotely control the release of breathable gas from a compressed gas source.

Still another object of the present invention is to enable a user to receive breathable gas on demand by varying the biting force applied to an actuator and thereby, remotely controlling the release of breathable gas from a compressed gas cylinder.

Still another object of the present invention is to enable manipulation of a first actuator to cause pivoting of a second actuator and operation of a valve.

Still another object of the present invention is to enable a user to supply breathable gas to a second individual by operating a plurality of actuators in series.

Still another object of the present invention is to depress a valve stem with a pivoting actuator.

Still another object of the present invention is to reduce the pressure and velocity of breathable gas released from a compressed gas source to levels acceptable for inhalation by a user without incorporating a conventional pressure regulator.

Still another object of the present invention is to adjustably preset a maximum flow of breathable gas from the compressed gas source.

Still another object of the present invention is to indicate the quantity of breathable gas available from a compressed gas source for future breathing.

Still another object of the present invention is to supply breathable gas to a user for a short period of time.

Still another object of the present invention is to supply breathable gas to a user through use of a lightweight, portable apparatus.

Still another object of the present invention is to supply breathable gas to a user at a low cost.

Other objects, features, and advantages of the present invention will become apparent upon reading and understanding the present specification when taken in conjunction with the appended drawings.

DETAILED DESCRIPTION OF THE PREFERRED EMBODIMENT

Figure 1:
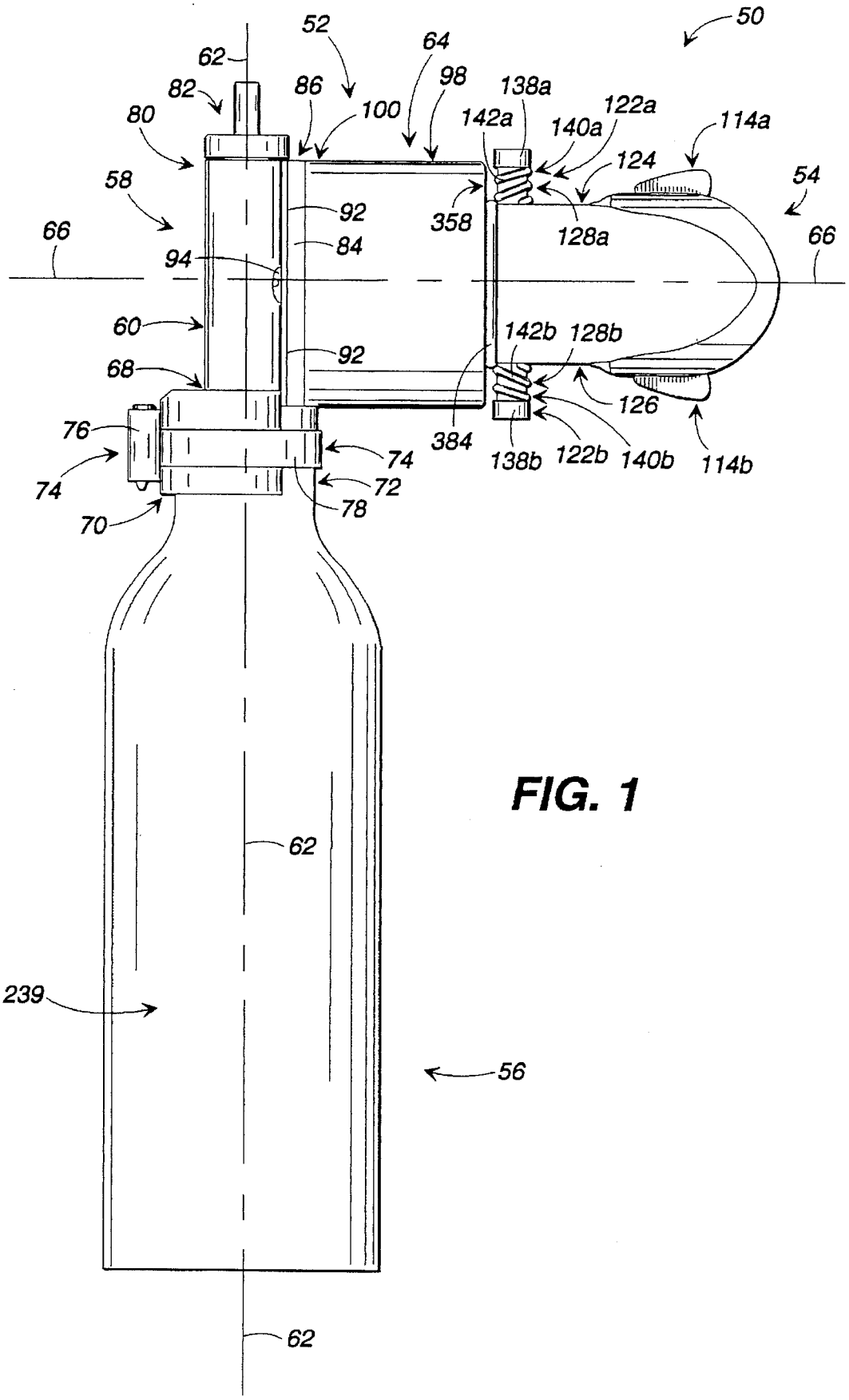
FIG. 1 is a front, elevational view of a breathing apparatus in accordance with the preferred embodiment of the present invention.

Referring now to the drawings, in which like numerals represent like components throughout the several views, a breathing apparatus 50, in accordance with the preferred embodiment of the present invention, is shown in FIGS. 1–4. The breathing apparatus 50 comprises an interface assembly 52 which is interposed in fluid communication between a mouthpiece 54 and a breathable gas source which is, preferably, a compressed gas cylinder 56 (also referred to herein as a container). The interface assembly 52 is removably mounted atop the compressed gas cylinder 56 to direct breathable gas from the compressed gas cylinder 56 to the mouthpiece 54 upon demand by a user.

The interface assembly 52 comprises a body 58 having an upright portion 60 which extends, generally, in a direction defined by a longitudinal axis 62 of the compressed gas cylinder 56 and a lateral portion 64 which extends, generally, in a direction defined by a longitudinal axis 66. The upright portion 60 of the body 58 has a first end 68 from which a collar portion 70 of the body 58 depends radially about longitudinal axis 62 and toward the compressed gas cylinder 56 to partially surround and enclose a neck 72 of the compressed gas cylinder 56. A band-type damp 74 secures the collar portion 70 to the neck 72 of the compressed gas cylinder 56 to limit rotational movement of the collar portion 70 relative to the compressed gas cylinder 56 and, hence, to limit rotational movement of the interface assembly 52 relative to the compressed gas cylinder 56. The band-type clamp 74 has a screw-type tensioner 76 and a band 78 which extends from the tensioner 76, around and in contact with the collar portion 70 and neck 72, and back through the tensioner 76 (see FIG. 4). The upright portion 60 also has a second end 80 longitudinally opposed from the first end 68. The second end 80 receives a pressure indicator 82.

Figure 3:
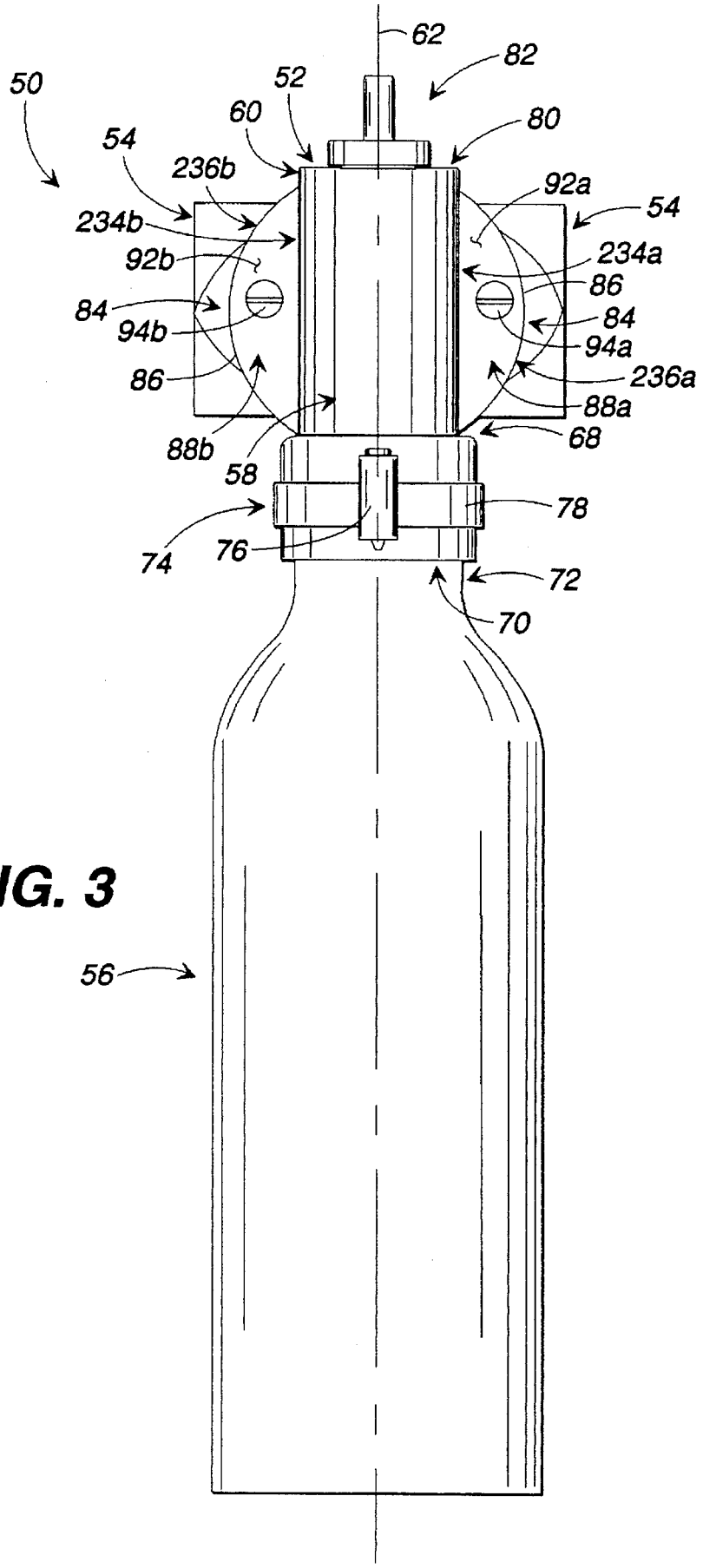
FIG. 3 is a left side, elevational view of the breathing apparatus of FIG. 1.
Figure 4:
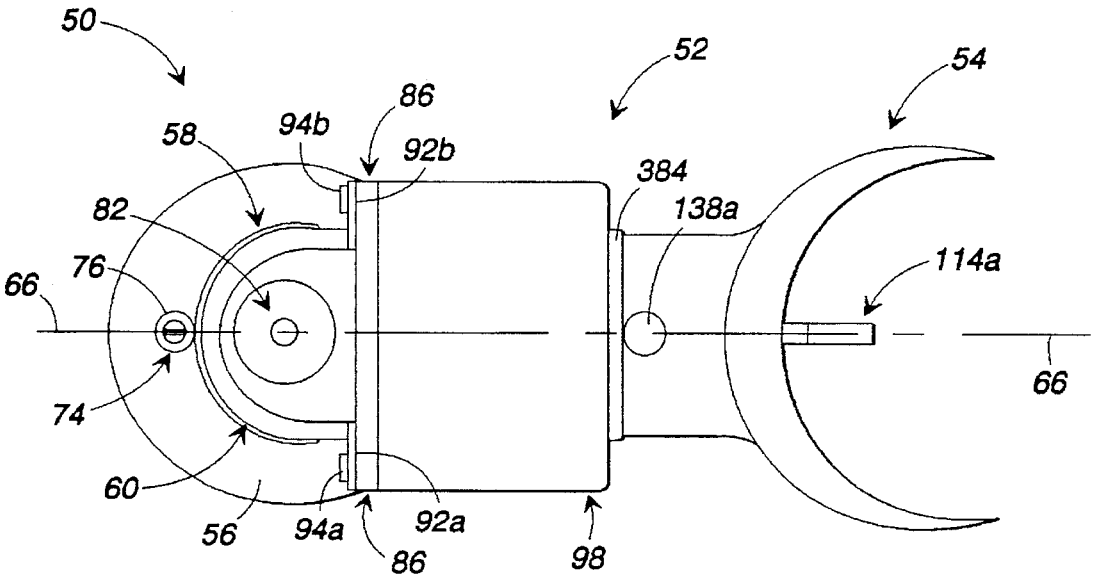
FIG. 4 is a top, plan view of the breathing apparatus of FIG. 1.

The lateral portion 64 of the body 58, in accordance with the preferred embodiment, integrally extends from the upright portion 60 of the body 58. The lateral portion 64 includes a base 84 which extends radially about longitudinal axis 66 between the first and second ends 68,80 of the upright portion 60 to form an edge 86 about the periphery of the base 84. As seen in FIGS. 3 and 4, the base 84 and its edge 86 extend laterally fore and aft of the upright portion 60 to define semi-circular exhaust regions 88 having exhaust ports 90 (see FIG. 13). The exhaust regions 88 and ports 90 are covered by exhaust flaps 92 which are flexibly held in position, preferably, by screws 94 removably inserted into holes 231 (see FIG. 13) defined by the base 84. A cover 98, discussed in more detail below, extends radially about longitudinal axis 66 and has a first end 100 which abuts the base 84. The cover 98 also extends longitudinally toward a second end 102 (see FIGS. 5 and 6) which is received by the mouthpiece 54. Together, the cover 98 and the base 84 define a transfer chamber 104 which, in cooperation with the upright portion 60, partially enables the transfer of breathable gas between the compressed gas cylinder 56 and the mouthpiece 54 and the transfer of exhaust gas (i.e., exhaled by a user) between the mouthpiece 54 and the exhaust ports 90 (see FIG. 13) which extend through the base 84.

Figure 2:
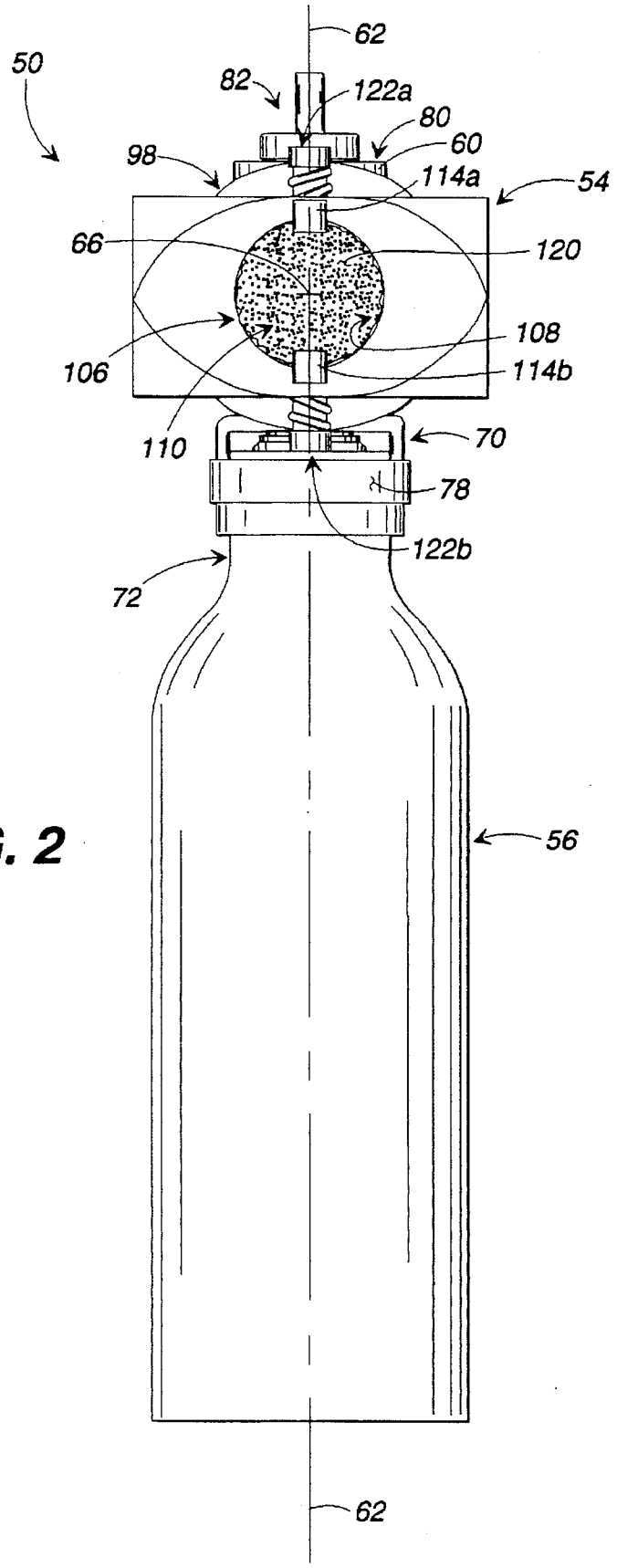
FIG. 2 is a right side, elevational view of the breathing apparatus of FIG. 1.

As seen in FIG. 2, the mouthpiece 54 includes a wall 106 having an inner surface 108 which defines a bore 110 extending radially about longitudinal axis 66. The mouthpiece bore 110 is in fluid communication with a similar radially-extending, coaxial bore 112 defined by the cover 98 (see FIGS. 5 and 6), thereby enabling the passage of exhaust gas between a user's mouth and the transfer chamber 104. A pair of vertically-opposed internal actuators 114 extend from the lateral portion 64 of the body 58 (where they interface with a valve as described below) and through the mouthpiece and cover bores 110,112 (via the transfer chamber 104) to allow interaction with a user's teeth. The upper and lower internal actuators 114*a*, 114*b* rest, as illustrated in FIG. 2, against the wall 106 of the mouthpiece bore 110 when no breathable gas flow is desired, thereby defining a "no-flow" position for the internal actuators 114 and a "no-flow" condition for the breathing apparatus 50. A biasing member 120 resides between and partially around the internal actuators 114 and also contacts the inner surface 108 of the mouthpiece wall 106. The biasing member 120 presses against each internal actuator 114, thereby biasing one actuator 114*a* relative to the other actuator 114*b* and tending to push each actuator 114 into contact with the inner surface 108 of the mouthpiece wall 106. Preferably, the biasing member 120 is manufactured from foam rubber having a plurality of pores of a sufficiently large size to enable the passage of gas through the pores and yet, sufficiently small to limit the passage of most solid matter (thereby filtering the gas) which might, otherwise, enter the mouthpiece 54 from the transfer chamber 104.

Figure 6:
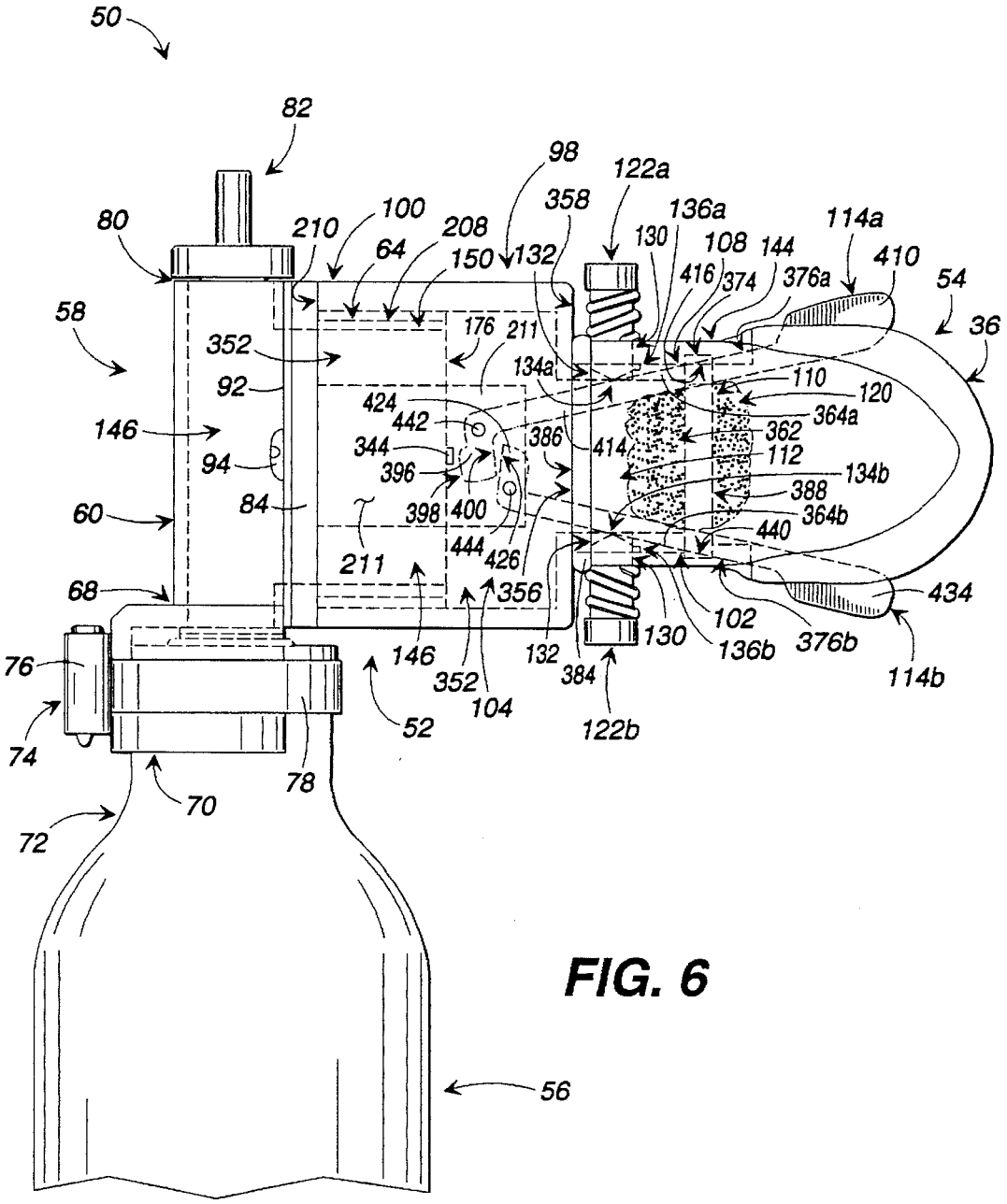
FIG. 6 is a partial, front, elevational view of the breathing apparatus of FIG. 1 in a "no-flow" condition where internal components and features normally hidden from view are displayed with hidden lines.

In accordance with the preferred embodiment, the interface assembly 52 further comprises a pair of vertically, opposed external actuators 122, seen most clearly in FIGS. 1 and 6, located at a top 124 and bottom 126 of the mouthpiece 54. While the following discussion refers to only one external actuator 122, it is understood that the discussion applies equally to each external actuator 122 since they are substantially similar. The external actuator 122 includes a shank portion 128 which extends through holes 130, 132 defined by the mouthpiece 54 and cover 98, respectively. The shank portion 128 has a first end 134 which contacts an internal actuator 114 when the internal actuator is positioned in a "no-flow" position. A stop 136 extends laterally from the first end 134 of the shank portion 128 and limits upward travel of the external actuator 122. The external actuator 122 also has a cap 138 connected to a second end 140 the shank portion 128 and a biasing member 142 which is located about the shank portion 128 between the cap 138 and an outer surface 144 of the mouthpiece 54.

The biasing member 142 is, preferably, a coil spring having a spring constant sufficient to return the external actuator 122 to its "no-flow" position (defined as the position of the external actuator 122 when the contacted internal actuator 114 is in its "no-flow" position) as depicted in FIG. 1.

Figure 5:
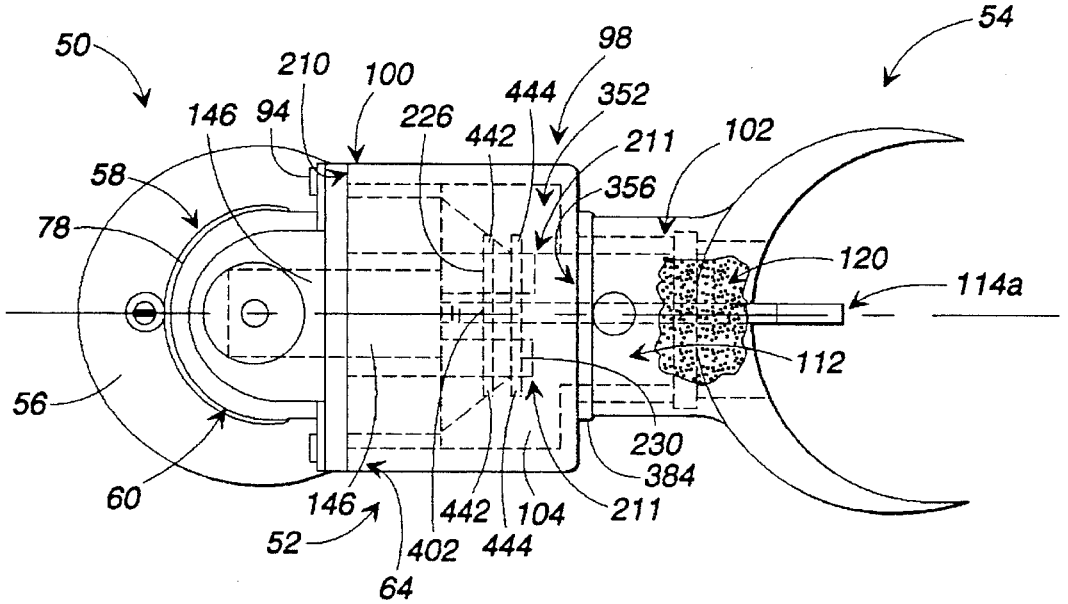
FIG. 5 is a top, plan view of the breathing apparatus of FIG. 1 where internal components and features normally hidden from view are displayed with hidden lines.
Figure 7:
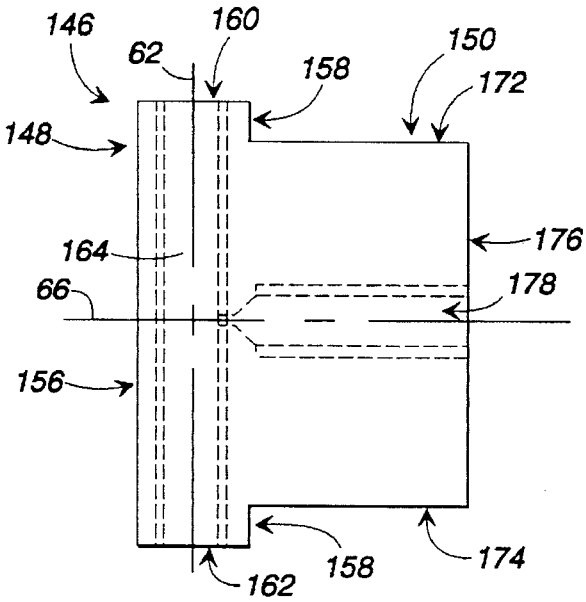
FIG. 7 is an isolated, front, elevational view of an insert which resides within a body portion of the breathing apparatus of FIG. 1.
Figure 8:
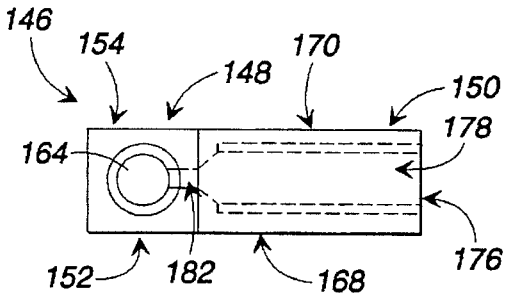
FIG. 8 is an isolated, top, plan view of the insert of FIG. 7.
Figure 9:
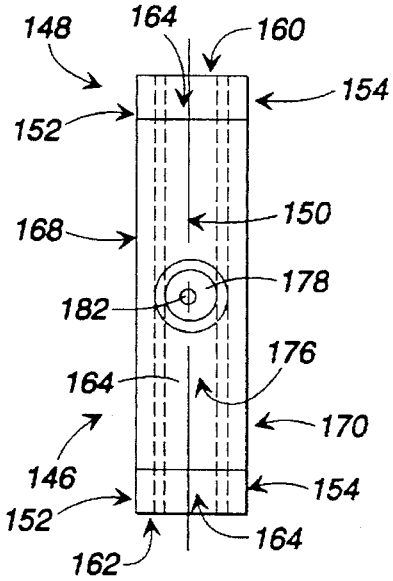
FIG. 9 is an isolated, right side, elevational view of the insert of FIG. 7.

Referring now to FIGS. 5 and 6 which, through the use of hidden lines, better display the relationship of the various elements of the breathing apparatus 50, the body 58 includes an insert 146 having a, generally, "T-shape" where the top of the "T" extends between the first and second ends 68,80 of the upright portion 60 of the body 58 and the leg of the "T" extends into the lateral portion 64 of the body 58. The insert 146 is, preferably, machined from Aluminum 7071. In an alternate embodiment, the insert 136 is cast from Almag 535 brass. As illustrated more clearly in FIGS. 7–9, the insert 146, similar to the body 58, has an upright portion 148 and a lateral portion 150 which protrudes from the upright portion 148. The insert's upright portion 148 has a front side 152 opposed to a back side 154 and a left side 156 opposed to right sides 158. Together, the sides 152,154,156,158 extend to form opposite top and bottom ends 160,162 having, generally, rectangular shapes. A first threaded bore 164 extends radially about longitudinal axis 62 between the top and bottom ends 160,162. The insert's lateral portion 150 has a from side 168 opposed to a back side 170 and a top 172 opposed to a bottom 174. The front and back sides 168,170 of the insert's lateral portion 150 are, preferably, coplanar with the front and back sides 152,154 of the insert's upright portion 148. The front and back sides 168, 170 of the insert's lateral portion 150, in conjunction with the top 172 and bottom 174 of the insert's lateral portion 150, form a right end 176 having a, generally, rectangular shape. A second threaded bore 178, starting at the right end 176, extends radially about longitudinal axis 66 (which is, preferably, perpendicular to and bisects longitudinal axis 62) within the insert's lateral portion 150. A channel 182 having a, preferably, circular cross-section extends laterally between the first threaded bore 164 and the second threaded bore 178 to connect the bores 164, 178 in fluid communication.

Figure 10:
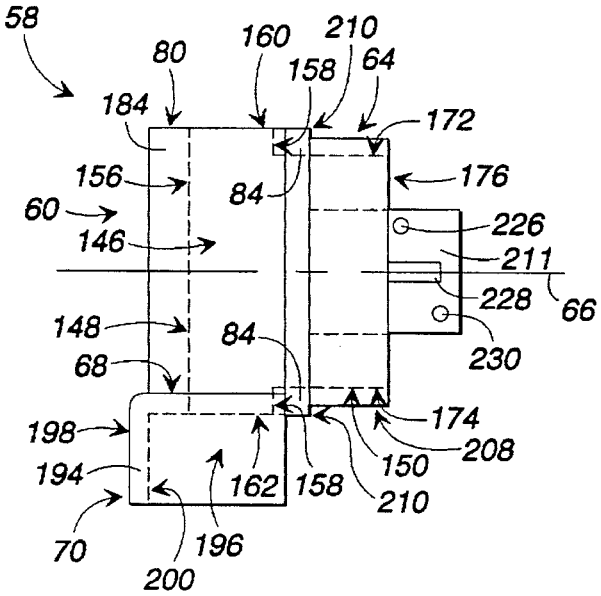
FIG. 10 is an isolated, front, elevational view of the body portion of the breathing apparatus of FIG. 1 where the insert is displayed with hidden lines.
Figure 11:
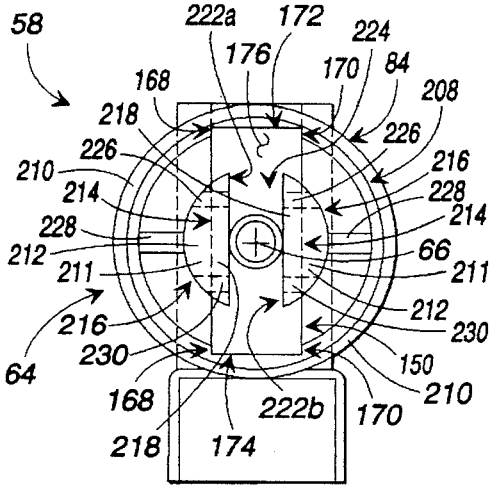
FIG. 11 is an isolated, right side, elevational view of the body portion of FIG. 10.
Figure 12:
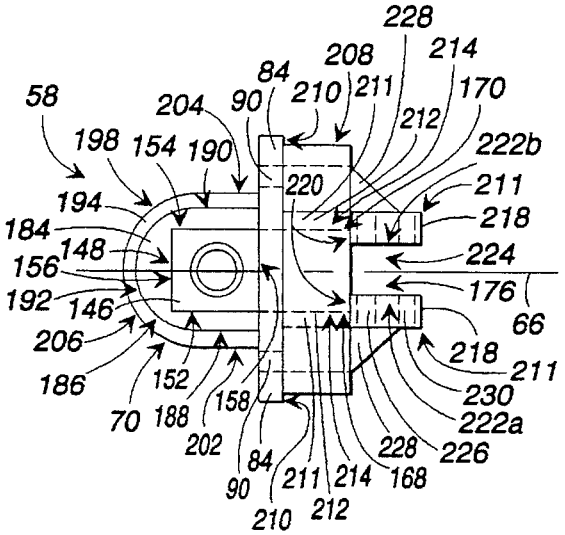
FIG. 12 is an isolated, top, plan view of the body portion of FIG. 10.

As illustrated more clearly in FIGS. 10–13 which display the body 58 in isolation, the insert's upright portion 148 resides within the body's upright portion 60 and the insert's lateral portion 150 extends into the body's lateral portion 64. Preferably, the body's upright and lateral portions 60,64 are injection-molded from high-density polyethylene plastic. The insert 146 is positioned within the mold cavity, preferably, during the molding process so as to align the top and bottom ends 160,162 of the insert's upright portion 148 with the first and second ends 68,80 of the body's upright portion 60 (see FIG. 10), thereby leaving the insert's top and bottom ends 160,162 exposed at the first and second ends 68,80 of the body's upright portion 60. As seen in FIGS. 10 and 12, the body's upright portion 60 envelopes the front, back, left, and fight sides 152,154,156,158 of the insert's upright portion 148 to form a wall 184 around and in contact with the insert's upright portion 148. The wall 184 extends from the base 84 and has an exterior surface 186 including front and back sections 188,190 opposed to the front and back sides 152, 154, respectively, of the insert's upright portion 148 and an arcuate section 192 extending between the front and back sections 186,188. Note also that the body's collar portion 70 comprises a wall 194 extending from the first end 68 of the body's upright portion 60 to define a receptacle 196 for receipt of the neck 72 of the compressed gas cylinder 56. The collar portion's wall 194 has an exterior surface 198 and an interior surface 200 which each include from and back sections 202,204 opposed to the from and back sides 152, 154, respectively, of the insert's upright portion 148 and an arcuate section 206 extending between the front and back sections 202,204.

In accordance with the preferred embodiment and as seen in FIGS. 10–13, the base 84 of the body's lateral portion 64 extends radially about longitudinal axis 66. The body's lateral portion 64 also includes a guide portion 208 which extends laterally from the base 84 (and radially about the longitudinal axis 66) to align with the right end 176 of the insert's lateral portion 150. The guide portion 208 and the remainder of the base 84 define a shoulder 210 which, in conjunction with the guide portion 208, receive and properly align the cover 98 and base 84. As seen in FIG. 11, the top 172, bottom 174, and portions of the front and back sides 168, 170 (nearest the top 172 and bottom 174) of the insert's lateral portion 150 are, preferably, embedded within the guide portion 208. The body's lateral portion 64 further comprises a pair of protruding members 211 which extend laterally from the body's upright portion 60 and, preferably, equidistant from longitudinal axis 66 to a point beyond the right end 176 of the insert's lateral portion 150 (see FIGS. 10 and 12). The protruding members 211 include a first portion 212 having an inner surface 214 which resides adjacent to a front side 168 or back side 170 of the insert's lateral portion 150 and an arcuate outer surface 216 (see FIGS. 11 and 12). The protruding members 211 also include a second portion 218 having a surface 220 which resides adjacent to the fight end 176 of the insert's lateral portion 150, thereby enabling the second portion 218 to overlap and contact the right end 176 of the insert's lateral portion 150. Such contact significantly limits any lateral movement of the insert 146 relative to the body 58 in the direction of longitudinal axis 66. Each second portion 218 of the protruding members 211 also has a surface 222 which borders the insert's second threaded bore 178. Together, surfaces **222*a*,222*b* define a gap 224 between the surfaces 222*a*,222*b* (see FIGS. 11 and 12) for receipt of the interior actuators 114. To aid in positioning the interior actuators 114, an upper hole 226 is defined by each protruding member 211 above a rib 228 which connects each protruding member 211 and the guide portion 208 of the base 84. Similarly, a lower hole 230 is defined by each protruding member 211 below a rib 228, but more laterally distant from the fight end 176 of the insert's lateral portion 150 than the upper holes 226**.

Figure 13:
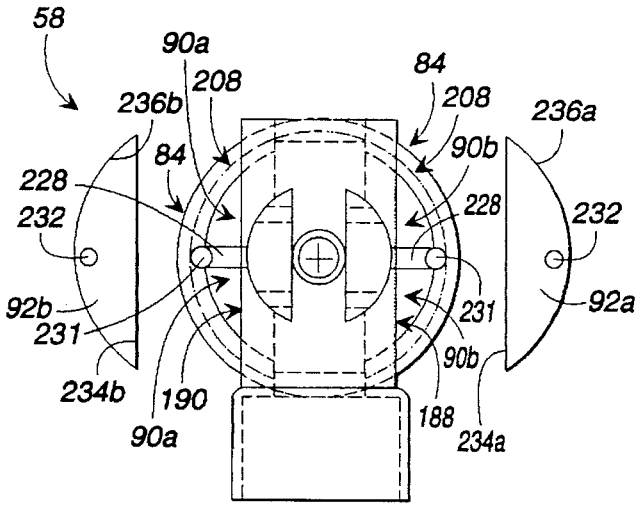
FIG. 13 is an isolated, left side, elevational view of the body portion of FIG. 10 where the exhaust flaps are exploded from the remainder of the body portion to enable viewing of the exhaust ports.
Figure 14:
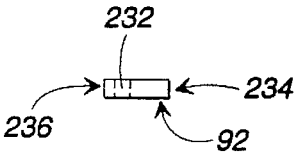
FIG. 14 is an isolated, top, plan view of an exhaust flap of the body portion of FIG. 10.
Figure 15:
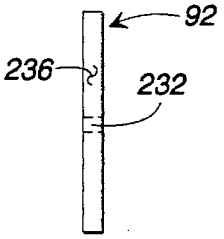
FIG. 15 is an isolated, side, elevational view of an exhaust flap of the body portion of FIG. 10.

As displayed in FIG. 13, the guide portion 208 of the base 84 and the front and back sections 188,190 of the body's upright portion 60 define the exhaust ports 90 which extend through the base 84 (see FIGS. 12 and 13) at locations above and below the ribs 228. A hole 23 1 is defined at the intersection of each rib 228 and the guide portion 208 for receipt of a screw 94 (see FIGS. 1, 3, and 4) which extends first through a hole 232 defined by the exhaust flap 92 (see FIGS. 13, 14 and 15). Screws **94*a*,94*b* secure exhaust flaps 92*a*,92*b* in place over the exhaust ports 90*a*,90*b*. Each exhaust flap 92 is molded, preferably, from silicone rubber and has a straight side 234 and an arcuate side 236. The straight side 234*a* of exhaust flap 92*a* resides adjacent to the front section 188 of the body's upright portion 60, while the arcuate side 236*a* aligns with and resides adjacent to the edge 86 of the base 84 (see FIG. 3). Similarly, the straight side 234*b* of exhaust flap 92*b* resides adjacent to the back section 190 of the body's upright portion 60, while the arcuate side 236*b* aligns with and resides adjacent to the edge 86 of the base 84. The dotted lines in FIG. 13 depict the alignment of the exhaust flaps 92 over the exhaust ports 90. Note that each exhaust flap 92 is made sufficiently thin to enable the flap 92 to flex about the screw 94 and away from the base 84, thereby allowing exhaust air to pass through the corresponding exhaust port 90 when a user exhausts gases into the mouthpiece 58**.

Figure 16:
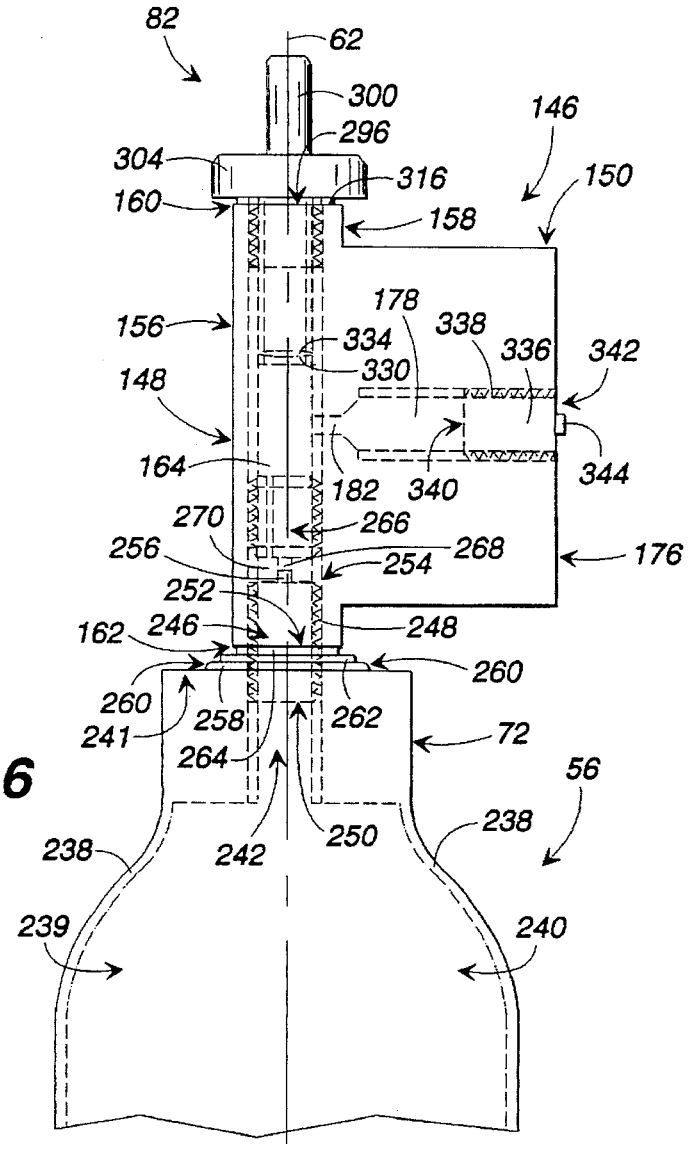
FIG. 16 is a partial, front, elevational view of the breathing apparatus of FIG. 1 where various components have been removed from view in order to expose the insert of FIG. 7 and components internal to the insert.

Referring now to the partial front view of FIG. 16 in which the molded portions of the body 58 have been removed for clarity, the relationship between the compressed gas cylinder 56 and internal components of the insert 146 is seen. The compressed gas cylinder 56 comprises a wall 238 which defines a reservoir 240 containing compressed, breathable gas 239. The neck 72 of the compressed gas cylinder 56 defines a threaded bore 242 which extends radially about longitudinal axis 62 and longitudinally between the reservoir 240 and a top end 241 of the compressed gas cylinder 56. The threaded bore 242 of the compressed gas cylinder 56 and the first threaded bore 164 of the insert 146 are aligned along longitudinal axis 62. Preferably, the compressed gas cylinder 56 is a conventional cylinder manufactured by the Luxfer Company of Nottingham, England. In accordance with the preferred embodiment, the compressed gas cylinder 56 contains 1.5 cubic feet of air pressurized to 3,000 pounds per square inch. It is understood that the scope of the present invention includes compressed gas cylinders containing other breathable gases in different volumes and at different pressures.

A source valve 246, having external threads 248, is partially received by the threaded bore 242 of the compressed gas cylinder 56 and the first threaded bore 164 of the insert 146. The source valve 246 is, preferably, a conventional tire valve utilized in passenger and truck car tires and available from Myer Tire Supply Company of Atlanta, Ga. The source valve 246 has a first end 250 which extends toward the gas cylinder's reservoir 240 for receipt of compressed gas from the reservoir 240. A portion of the external threads 248 of the source valve 246 engage the internally threaded bore 242 of the compressed gas cylinder 56 to secure the source valve 246 in position. From its first end 250, the source valve 246 extends through a portal 252 defined by the bottom end 162 of the insert's upright portion 148. The portal 252 enables access to and provides fluid communication with the insert's first threaded bore 164. A second end 254 of the source valve 246, having a valve stem 256, extends toward the top end 160 of the insert's upright portion 148. A portion of the external threads 248 of the source valve 246 engage the internal threads of the insert's first threaded bore 164. As seen in FIG. 16, a washer 258, having turned down outer edges 260 (i.e., to define a downward opening receptacle) and a central bore, resides about the source valve 246 as it extends from the compressed gas cylinder 56. The washer 258 receives a first "O"-ring (not visible) which resides immediately atop the compressed gas cylinder 56 and within the washer's receptacle to limit gas leakage from the compressed gas cylinder 56. A hex nut 262, having a threaded bore, threadedly engages the valve's external threads 248 and is positioned atop the washer 258 to secure the washer 258 in place. A second "O"-ring 264, employed to further reduce the potential for gas leakage, has a central bore which receives source valve 246. The second "O"-ring 264 rests between the top of hex nut 262 and the insert's bottom end 162 which is tightened against the second "O"-ring 264 during assembly by rotating the insert 146 relative to the compressed gas cylinder 56 to engage the valve's external threads 248 and the first threaded bore 164 of the insert 146.

Figure 19:
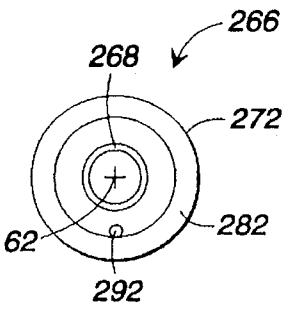
FIG. 19 is an isolated, end, elevational view of the opposite end of the valve actuator of FIG. 17.
Figure 17:
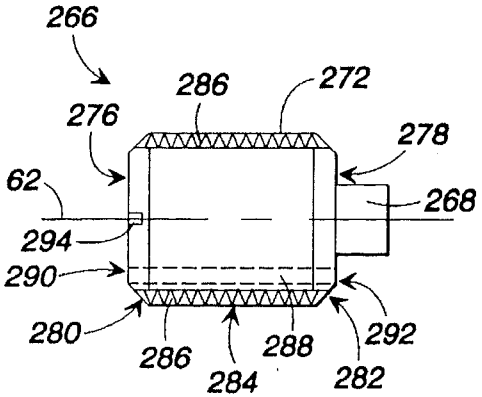
FIG. 17 is an isolated, front, elevational view of the valve actuator of FIG. 16.
Figure 18:
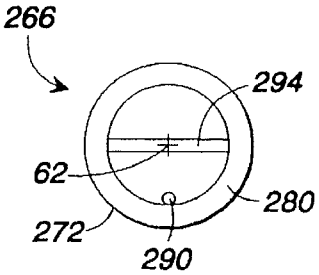
FIG. 18 is an isolated, end, elevational view of the valve actuator of FIG. 17.

As shown in FIG. 16, a valve actuator 266, having a protrusion 268, resides within the insert's first threaded bore 164 adjacent to the source valve 246 between the source valve 246 and the top end 160 of the insert 146. The protrusion 268 abuts valve stem 256 and, in conjunction with the valve stem 256, the remainder of the source valve 246, the remainder of the valve actuator 266, and the insert's first threaded bore 164, defines an annular volume 270 within the first threaded bore 164 for receipt of breathable gas continually flowing from the compressed gas cylinder 56 via the source valve 246. The valve actuator 266 is displayed more dearly in the isolated views of FIGS. 17–19 and has an outer surface 272 extending radially about longitudinal axis 62 between a first end 276 and a second end 278. The outer surface 272 comprises a first chamfered portion 280, a second chamfered portion 282, and a cylindrical portion. 284 which extends between the first and second chamfered portions 280,282. The first chamfered portion 280 transitions between the, generally, circular-shaped first end 276 and the cylindrical portion 284. Similarly, the second chamfered portion 282 transitions between the, generally, circular-shaped second end 278 and the cylindrical portion 284. External threads 286 extend between the first and second chamfered portions 280,282 and engage the threads of the insert's first threaded bore 164. A bore 288, offset radially from the longitudinal axis 62, extends between the first and second ends 276,278 of the valve actuator 266. The first end 276 of the valve actuator 266 defines a first aperture 290 which enables breathable gas to pass between the bore 288 and the portion of the first threaded bore 164 extending between the valve actuator 266 and the pressure indicator 82. The second end 278 of the valve actuator 266 defines a second aperture 292 which enables breathable gas to pass between the annular volume 270 and the bore 288 and, hence, between the source valve 246 and the bore 288. A slot 294 defined by the first end 276 of the valve actuator 266 receives a screwdriver blade during assembly to enable positioning of the valve actuator 266 relative to the source valve 246. Note that the diameters of the first and second threaded bores 164,178, channel 182, and bore 288 are selected to enable the first and second threaded bores 164,178, channel 182, and bore 288 to cooperatively reduce the pressure and velocity of the breathable gas released from the compressed gas cylinder 56 to an acceptable level for human consumption. Also, note that the valve actuator 266 functions as a baffle to further reduce the pressure and velocity of the breathable gas released from the compressed gas cylinder 56.

Figure 20:
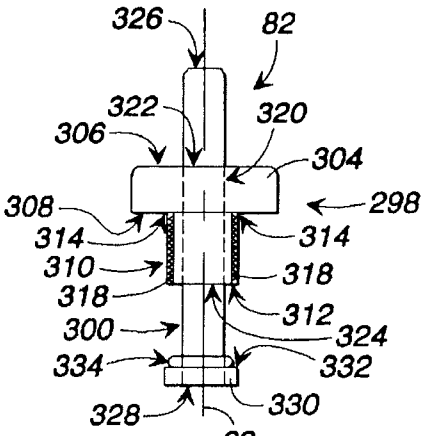
FIG. 20 is an isolated, elevational view of the pressure indicator of the breathing apparatus of FIG. 1.

The top end 160 of the insert's upright portion 148, as seen in FIG. 16, defines a portal 296 which enables access to the first threaded bore 164 and removable mounting of the pressure indicator 82. Illustrated more dearly in the isolated view of FIG. 20, the pressure indicator 82 comprises a cap portion 298 and a rod portion 300 which slides relative to the cap portion 298. The cap portion 298, symmetrical about longitudinal axis 62, comprises a head 304 having, generally, circular upper and lower surfaces 306,308 (see FIG. 4) which extend radially beyond the front, back, left, and right sides 152,154,156,158 of the insert's upright portion 148. The cap portion 298 further comprises a protrusion 310 which extends from the lower surface 308 of the head 304 to an end 312. The protrusion 310 and lower surface 308 of the head 304 define an annular shoulder 314. An "O"-ring 316 resides between the annular shoulder 314 and the top end 160 of the insert's upright portion 148 to limit gas leakage from the first threaded bore 164. The protrusion 310, received by the first threaded bore 164, has external threads 318 which engage the threads of the first threaded bore 164. A bore 320 is defined by the cap portion 298 and extends radially about longitudinal axis 62 between the upper surface 306 of the cap's head 304 and the protrusion's end 312. The upper surface 306 of the cap's head 304 and end 312 of the protrusion 310 define openings 322,324, respectively, which enable the rod portion 300 to extend through the bore 320 as discussed below. The rod portion 300 has is, generally, symmetrical about the longitudinal axis 62. The rod portion 300 has a first end 326 extending from the bore 320, via opening 322, above the upper surface 306 of the head 304. A second end 328 of the rod portion 300 extends from the bore 320, via opening 324, into the first threaded bore 164 of the insert's upright portion 148. An annular disc 330 extends radially around the periphery of the rod portion 300 near its second end 328 to define a shoulder 332. An "O"-ring 334, having a central bore, resides around the periphery of the rod portion 300 and adjacent to the shoulder 332.

In accordance with the preferred embodiment, a remote valve 336 resides in the second threaded bore 178 of the insert's lateral portion 150 and has external threads 338 which engage the threads of the second threaded bore 178. Preferably, the remote valve 336 is a conventional passenger car or truck tire valve available from Myer Tire Supply Company of Atlanta, Ga. The remote valve 336 has a first end 340 which extends toward the insert's channel 182 to receive breathable gas passing into the second threaded bore 178 from the first threaded bore 164. A second end 342 of the remote valve 336 is coplanar with the fight end 176 of the insert's lateral portion 150. A valve stem 344 extends from the second end 342 between the protruding members 211 of the insert's lateral portion 150, thereby positioning the valve stem 344 for manipulation by the internal actuators 114 to control breathable gas flow through the remote valve 336 (see FIG. 6).

Figure 23:
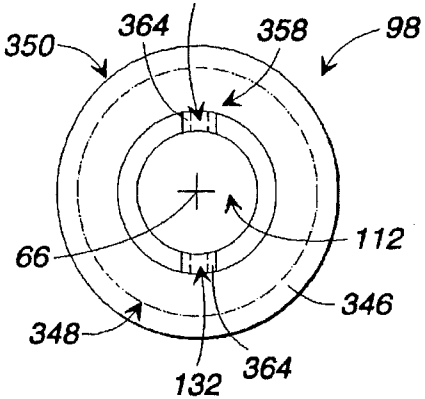
FIG. 23 is an isolated, end, elevational view of the opposite end of the cover of FIG. 21.
Figure 22:
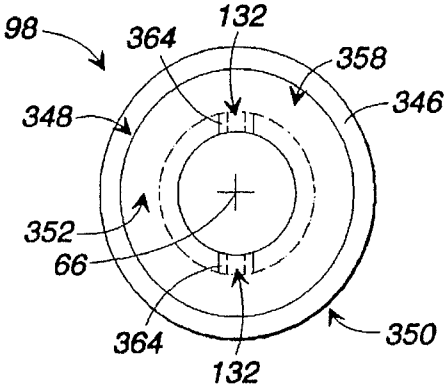
FIG. 22 is an isolated, end, elevational view of the cover of FIG. 21.
Figure 21:
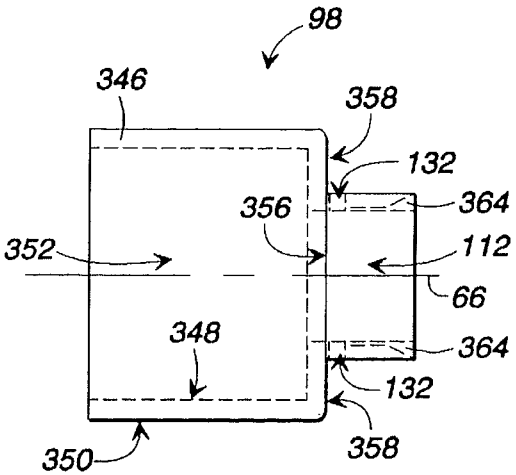
FIG. 21 is an isolated, front, elevational view of the cover of the breathing apparatus of FIG. 1.

Referring now to FIGS. 21–23, the cover 98 is, preferably, injection-molded from high-density polyethylene plastic and includes a wall 346 having an inner surface 348 and an outer surface 350. The wall 346 defines a first bore 352 and the smaller, second bore 112 (referred to above) extending radially about longitudinal axis 66. The wall 346 further defines a radial opening 356 about longitudinal axis 66 (which enables fluid communication between the first and second bores 352, 112) and a shoulder 358 extending radially around the opening 356. The first bore 352 extends longitudinally between the opening 356 and a first radial portal 362 defined at the first end 100 of the cover 98. The second bore 112 extends longitudinally between the opening 356 and a second radial portal 362 defined at the second end 102 of the cover 98. The wail 346 also defines a pair of diametrically-opposed slots 364 which extend between the wall's inner and outer surfaces 348,350 near the second end 102. From their maximum size at the cover's second end 102, the slots 364 taper toward opening 356.

The first bore 352, as displayed in FIGS. 5 and 6, partially receives the lateral portion 64 of the interface assembly's body 58 and internal actuators 114. The first end 100 of the cover 98 abuts the shoulder 210 of the body's lateral portion 64 and a part of the cover's inner surface 348 rests adjacent to and around the guide portion 208 of the body's lateral portion 64. Note that the cover 98 is not fixedly secured to the base 84, thereby enabling the cover 98 to be removed from the base 84 for maintenance, storage, or other purposes. The second bore 112 partially receives the internal actuators 114 which extend through opening 356 and second portal 362. The slots 364 partially receive the internal actuators 114 when the actuators 114 are positioned in their "no-flow" position as seen in FIG. 6.

Figure 24:
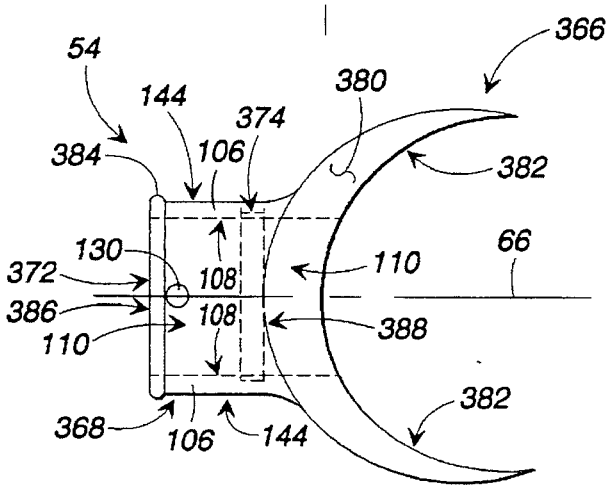
FIG. 24 is an isolated, top, plan view of the mouthpiece of the breathing apparatus of FIG. 1.
Figure 25:
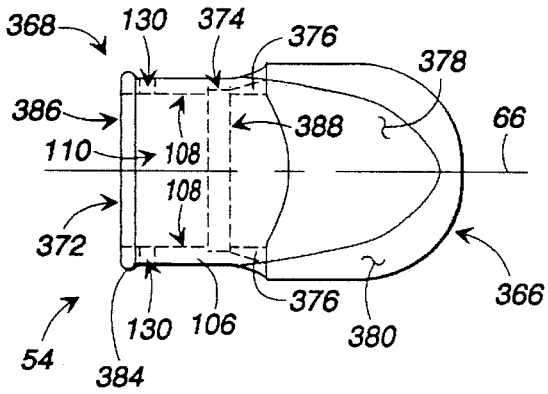
FIG. 25 is an isolated, front, elevational view of the mouthpiece of FIG. 24.
Figure 26:
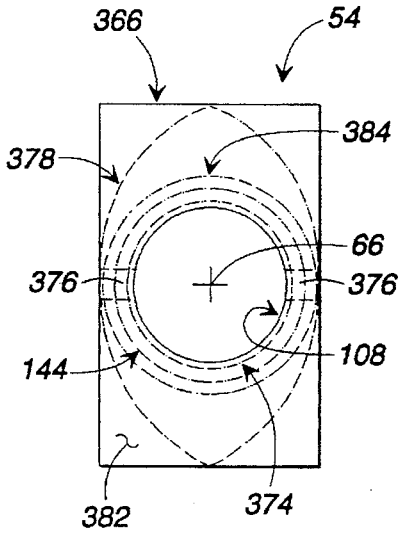
FIG. 26 is an isolated, fight side, elevational view of the mouthpiece of FIG. 24.

FIGS. 24–26 display the mouthpiece 54 isolated from the remainder of the breathing apparatus 50 and in accordance with the preferred embodiment of the present invention. Preferably, the mouthpiece 54 is molded from silicone rubber. The mouthpiece 54 includes a mouth-engaging portion 366 and a cover-engaging portion 368 extending longitudinally from the mouth-engaging portion 366. Mouthpiece wall 106 defines radial bore 110 (referred to above) which is disposed between an end 372 and the mouth-engaging portion 366. The wall 106 also defines a radial recess 374 about longitudinal axis 66 near the location where the cover-engaging portion 368 connects to the mouth-engaging portion 366. The wall 106 further defines a pair of diametrically-opposed slots 376 which extend from the radial recess 374 in a direction toward the mouth-engaging portion 366. Similar to the cover slots 364, the mouthpiece slots 376 taper, as seen in FIG. 25 for receipt of the internal actuators 114. The mouth-engaging portion 366 includes outer surfaces 378,380 which reside partially within a user's mouth and rest against a user's lips when the breathing apparatus 50 is in use. The mouth-engaging portion 366 also includes an inner surface 382 having a, generally, semi-circular shape which rests partially against a user's teeth and gums.

The mouthpiece's wall 106, as seen in FIGS. 1 and 6, has a radial protrusion 384 located at end 372 which abuts the cover's shoulder 358. The wall 106 defines a first portal 386, also located at end 372, which receives the part of the cover wall 346 defining the cover's second bore 112. The wall's inner surface 108 has a portion which rests adjacent to and around a portion of the outer surface 350 of the cover wall 346. A second portal 388 is defined by the mouthpiece wall 106 at a location near the mouth-engaging portion 366. The second portal 388 and bore 110 are in fluid communication, thereby enabling gas to flow between the cover's second portal 362 and the user's mouth.

Figure 27:
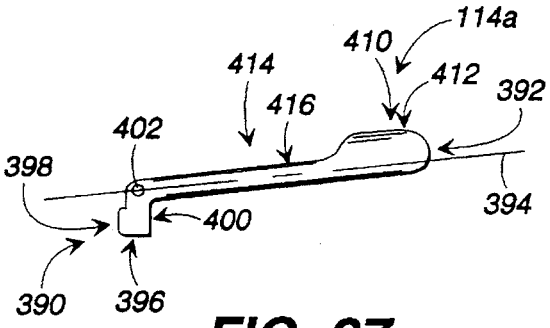
FIG. 27 is an isolated, fight side, elevational view of the upper internal actuator of the breathing apparatus of FIG. 1.
Figure 28:
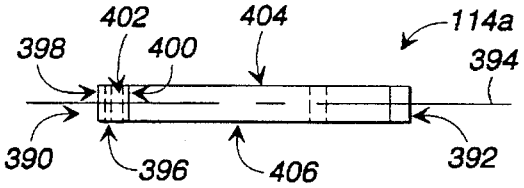
FIG. 28 is an isolated, bottom, plan view of the upper internal actuator of FIG. 27.
Figure 31:
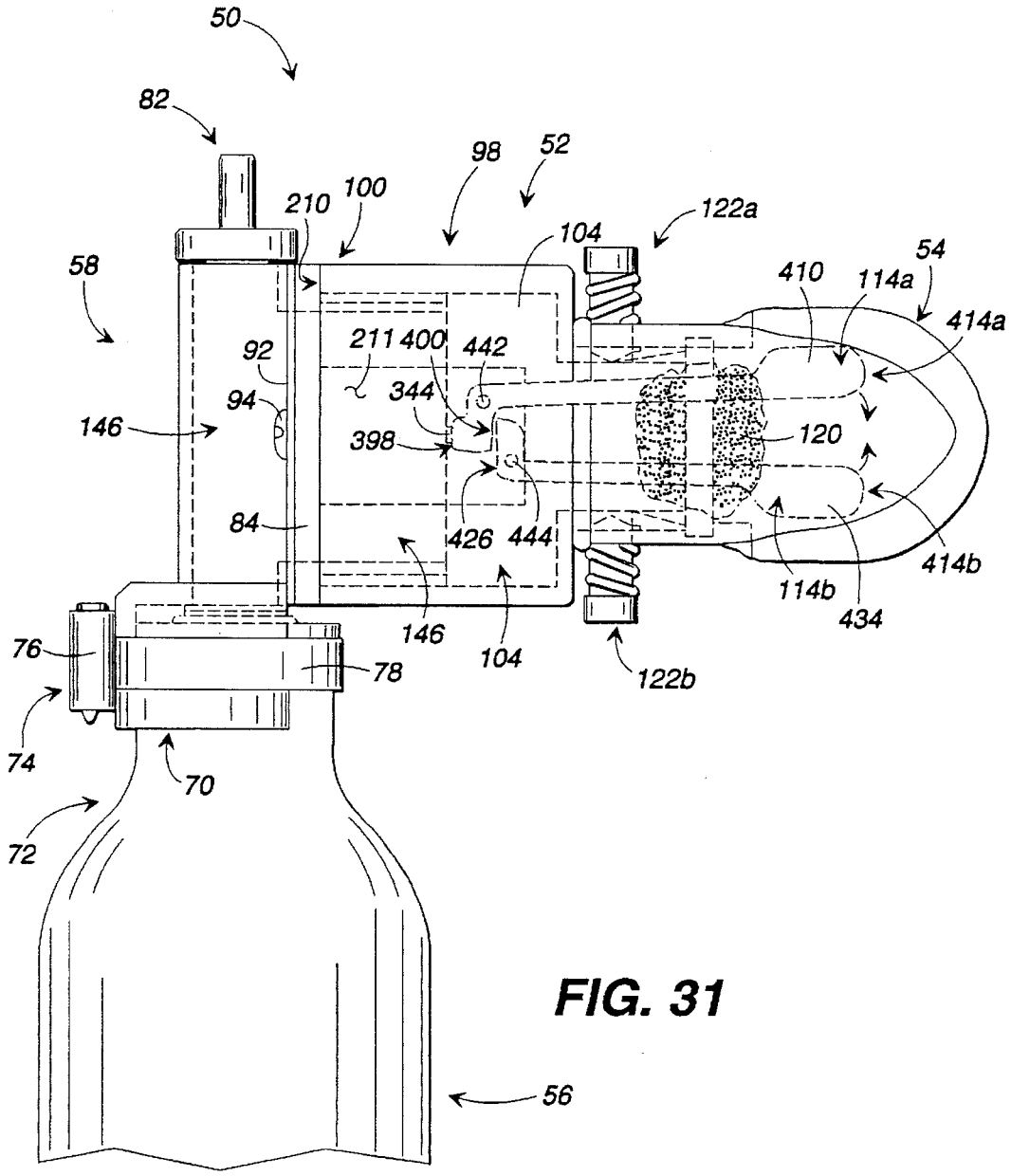
FIG. 31 is a partial, front, elevational view of the breathing apparatus of FIG. 1 in a "flow" condition where internal components and features normally hidden from view are displayed with hidden lines.

In accordance with the preferred embodiment, the breathing apparatus 50 includes an upper internal actuator **114*a* and a lower internal actuator 114*b* which are, preferably, injection-molded from high-density polyethylene plastic. As seen isolated in FIGS. 27 and 28, the upper internal actuator 114*a* includes a first end 390 and a second end 392 longitudinally displaced from the first end 390 along a longitudinal axis 394. A first portion 396 of the upper internal actuator 114*a*, having a first face 398 and an opposing second face 400, is offset from the longitudinal axis 394 at the first end 390. The first portion 396 is sized to enable it to reside within the gap 224 created by the protruding members 211. The first face 398 protrudes slightly from the first portion 396 at the first end 390 to enable better engagement of valve stem 344 (see FIG. 31). The upper internal actuator 114*a* also defines a hole 402 extending between a first side 404 and a second side 406 of the upper internal actuator 114*a* near the first portion 396. The upper internal actuator 114*a* also includes a second portion 410 located at the second end 392. The second portion 410 is somewhat rounded at second end 392 and defines a surface 412 which receives the teeth of a user when breathable gas is required by the user. The second portion 410 is joined to the first portion 396 by an intermediate portion 414 having an upper surface 416, parts of which reside within cover slot 364*a* and mouthpiece slot 376*a* when the upper internal actuator 114*a*** is in its "no-flow" position.

Figure 29:
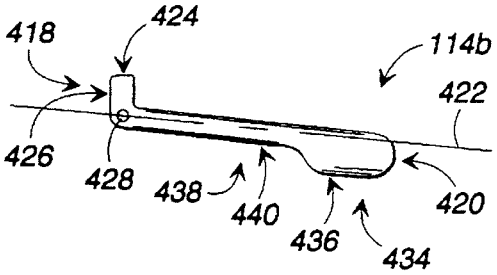
FIG. 29 is an isolated, fight side, elevational view of the lower internal actuator of the breathing apparatus of FIG. 1.
Figure 30:
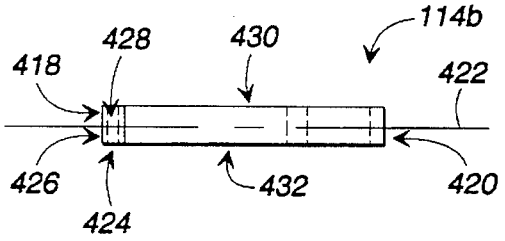
FIG. 30 is an isolated, bottom, plan view of the lower internal actuator of FIG. 29.

The lower internal actuator **114*b*, shown isolated in FIGS. 29 and 30, is similar in design to the upper internal actuator 114*a* and has a first end 418 and a second end 420 longitudinally displaced from the first end 418 along a longitudinal axis 422. A first portion 424, offset from the longitudinal axis 422, has a face 426 at the first end 418 and is sized to reside within the gap 224 formed by the protruding members 211. A hole 428 is defined by the lower internal actuator 114*b* near the first portion 424 and extends between a first side 430 and a second side 432. The lower internal actuator 114*b* also includes a second portion 434 positioned at the second end 420. The second portion 434 is somewhat rounded at second end 420 and defines a surface 436 which receives the teeth of a user when breathable gas is required by the user. The second portion 434 is connected to the first portion 424 by an intermediate portion 438 having a lower surface 440, parts of which reside within cover slot 364*b* and mouthpiece slot 376*b*** when the lower internal actuator is in its "no-flow" position.

FIGS. 5 and 6 display the relative positioning of the internal actuators 114 and the other components of the breathing apparatus 50 when no breathable gas is being demanded by a user and no breathable gas is being released (i.e., the "no-flow" position). The upper internal actuator **114*a* is pivotally positioned above the lower internal actuator 114*b* by a pin 442 extending through the upper holes 226 of the protruding members 211 and hole 402 of the upper internal actuator 114*a*. Preferably, the pin 442 is manufactured from stainless steel welding rod. Note that the first face 398 of the upper internal actuator's first portion 396 is positioned slightly apart from valve stem 344. Parts of the intermediate portion 414 of the upper internal actuator 114*a* extend through first cover bore 352, cover opening 356, cover second bore 112, cover second portal 362, mouthpiece bore 110, and mouthpiece second portal 388. The upper surface 416 of the intermediate portion 414 resides beneath and in contact with the first end 134 of the shank portion 128 of external actuator 122*a*. The upper surface 416 also resides, as described above, partially within the cover and mouthpiece slots 364*a*,376*a*. The second portion 410 of the upper internal actuator 114*a* protrudes partially from the mouth-engaging portion 366 of the mouthpiece 54**.

The lower internal actuator **114*b* is pivotally positioned below the upper internal actuator 114*a* by a pin 444 extending through the lower holes 230 of the protruding members 211 and hole 428 of the lower internal actuator 114*b*. Preferably, the pin 444 is manufactured from stainless steel welding rod. Note that the face 426 of the lower internal actuator's first portion 424 is positioned so as to barely contact the second face 400 of the upper internal actuator's first portion 396. Similar to the upper internal actuator 114*b*, parts of the lower internal actuator's intermediate portion 438 pass through first cover bore 352, cover opening 356, cover second bore 112, cover second portal 362, mouthpiece bore 110, and mouthpiece second portal 388. The intermediate portion's lower surface 440 rests above and in contact with the first end 134 of the shank portion 128 of external actuator 122*b*. The lower surface 440 also rests, as described above, partially within the cover and mouthpiece slots 364*b*,376*b*. The lower internal actuator's second portion 434 extends partially from the mouth-engaging portion 366 of the mouthpiece 54**.

In accordance with a first preferred method of the present invention, the breathing apparatus 50 is configured to adjust the maximum flow rate of breathable gas from the compressed gas cylinder 56 to a desired quantity by first removing the pressure indicator 82 from the upright portion 60 of the body 58. A screwdriver is then employed in cooperation with slot 294 of the valve actuator 266 to adjust the vertical position of the valve actuator's protrusion 268 relative to the valve stem 256 of source valve 246. Turning the slot 294 clockwise (as viewed from above) causes the valve actuator's protrusion 268 to depress the valve stem 256 more, thereby increasing the flow rate of breathable gas which continually flows from the compressed gas cylinder 56 into the annular volume 270, the valve actuator bore 288, the insert first threaded bore 164, the insert channel 182, and the insert second threaded bore 178. Conversely, turning the slot 294 counterclockwise (as viewed from above) causes the valve actuator's protrusion 268 to depress the valve stem 256 less, thereby decreasing the flow rate of breathable gas which continually flows from the compressed gas cylinder 56. After sufficient adjustment, the pressure indicator 82 is reinserted into the body's upright portion 60. The flow of breathable gas from the breathing apparatus 50 is then tested by squeezing the internal actuators 114 together to ascertain whether or not the flow rate of supplied gas matches the maximum flow rate desired by the user. If the supplied flow rate is too great or too little, the position of the valve actuator 266 relative to valve stem 256 is adjusted again. The adjustment process is continued repeatedly until the supplied flow of breathable gas matches the desired maximum flow of breathable gas.

After the step of configuration and in accordance with the first preferred method, the breathing apparatus 50 is secured to the user's body at a location which allows the user to receive the mouthpiece 54 within his mouth by moving his head only and without the assistance of his hands or feet. Then, upon the need for breathable gas, the user receives the mouthpiece 54 in his mouth and squeezes the internal actuators 114 together with his teeth to continually control the release of breathable gas from the compressed gas cylinder 56 (see FIG. 31 which displays the position of the internal actuators when breathable gas is released from remote valve 336 and which is referred to herein as a "flow" position or condition). More specifically, the application of biting force on the second portions 410,434 of the upper and lower internal actuators **114*a*, 114*b* causes the second portions 410,434 to move closer to each other. Such downward movement of the second portion 410 of the upper internal actuator 114*a* causes the upper internal actuator 114*a* to pivot about pin 442, thereby bringing the upper internal actuator's first face 398 into contact with valve stem 344 and transferring the biting force to the valve stem 344 to partially depress the valve stem 344 and release breathable gas from the remote valve 336. Corresponding upward movement of the second portion 434 of lower internal actuator 114*b* (due to the application of a biting force) causes the lower internal actuator 114*b* to pivot about pin 444 bringing the lower internal actuator's face 426 into increased contact with the upper internal actuator's second face 400, thereby transferring the biting force to the upper internal actuator 114*a*, causing the upper internal actuator 114*a* to pivot into the valve stem 344, and to depress the valve stem 344. Conversely, by removing the biting force applied to the second portions 410,434 of the internal actuators 114*a*, 114*b*, the biasing member 120 applies a biasing force to the internal actuators 114*a*, 114*b* tending to pivot the internal actuators 114 apart, thereby partially releasing the valve stem 344 and decreasing the flow rate of breathable from valve 336**.

It is understood that by independently controlling (i.e., increasing or decreasing) the amount of biting force applied to the second portion 410 of the upper internal actuator **114*a*, a user can continuously vary the position of the upper internal actuator 114*a* relative to the remote valve 336. By varying the position of the upper internal actuator 114*a*, the user can continuously control (i.e., increase or decrease) the flow rate of breathable gas released from the remote valve 336 and, hence, the compressed gas cylinder 56 (i.e., because breathable gas flows from the compressed gas cylinder 56 via the source valve 246 and through the valve actuator's bore 288 to replenish the breathable gas released from the insert's bores 164,178 and channel 182 by the remote valve 336). Similarly, it is also understood that by independently controlling (i.e., increasing or decreasing) the mount of biting force applied to the second portion 434 of the lower internal actuator 114*b*, a user can continuously control (i.e., increase or decrease) the flow rate of breathable gas released from the remote valve 336 and, hence, the compressed gas cylinder 56**.

In accordance with the preferred method, the manipulation of the valve stem 344 by control of the internal actuators 114, as described above, enables breathable gas to flow from the remote valve 336 and into the transfer chamber 104. As the user attempts to breath, a suction (or negative gas pressure) is created at the mouthpiece's second portal 388 and causes the breathable gas to flow from the transfer chamber 104, through cover opening 356, cover second bore 112, cover second portal 362, and the mouthpiece's second portal 388 before entering the user's mouth. When the user wishes to exhale, he decreases the biting force applied to an internal actuator 114 and exhales through the mouthpiece 54, thereby creating a positive gas pressure at the mouthpiece's second portal 388. The difference in gas pressure between the mouthpiece's second portal 388 and the transfer chamber 104 causes the exhaust gases to travel through the cover second portal 362, cover second bore 112, and cover opening 356 before reaching the transfer chamber 104. Upon reaching the transfer chamber 104, the positive pressure of the exhaust gases causes the exhaust flaps 92 covering the exhaust ports 90 to flex about screws 92 and away from the exhaust ports 90, thereby partially uncovering the exhaust ports 90 and enabling the exhaust gases to pass through the exhaust ports 90 to the surrounding environment. When the user finishes exhaling, the gas pressure inside the transfer chamber 104 decreases and allows the resiliency of the exhaust flaps 92 to return the exhaust flaps 92 to again cover the exhaust ports 90 and prevent the escape of gases from the transfer chamber 104. Note that the above method is repeated for as long as necessary to supply the user with breathable gas.

In accordance with an alternate method of the present invention, it is understood that the controlled application of sufficient vertical force (i.e., enough vertical force to overcome the opposing force generated by the biasing member 142) to either external actuator 122 causes the upper internal actuator **114*a* to depress valve stem 344, thereby enabling the flow of breathable gas from the remote valve 336 to be controlled without the application of biting force. Note that during use of an external actuator 122, the cooperating internal actuator 114 remains in constant contact with the external actuator 122 (i.e., more specifically, with the first end 134 of the external actuator's shank portion 140) being employed to release breathable gas from the remote valve 336. Upon removal of the vertical force applied to the external actuator 122, biasing member 142 returns the external actuator's shank portion 140 to its "no-flow" position as seen in FIG. 2, thus allowing the cooperating internal actuator 114** to return to its "no-flow" position as well.

Whereas this invention has been described in detail with particular reference to its most preferred embodiment, it is understood that variations and modifications can be effected within the spirit and scope of the invention, as described herein before and as defined in the appended claims. The corresponding structures, materials, acts, and equivalents of all means or step plus function elements in the claims below are intended to include any structure, material, or acts for performing the functions in combination with other claimed elements as specifically claimed.

I claim:

1. A method of supplying a breathable gas, said method comprising the steps of:

providing a reservoir containing a pressurized breathable gas;

providing a pair of actuators which diverge from each other through a predetermined angle;

providing a mouthpiece through which the pair of actuators extend;

continually controlling the release of the pressurized breathable gas from the reservoir in response to changes in the angle defined between the pair of actuators by application of a biting motion to an actuator of the pair of actuators; and channeling the pressurized breathable gas to the mouthpiece from the reservoir;

wherein the actuators of the pair of actuators extend into the mouthpiece from locations outside the mouthpiece and each actuator of the pair of actuators diverges from the other actuator of the pair of actuators while extending into the mouthpiece.

2. The method of claim 1 wherein, the method further comprises a step of providing a valve stem connected to the reservoir, and the step of continually controlling includes, at least, a step of selectively engaging and disengaging the valve stem by pivotal movement of an actuator of the pair of actuators relative to the valve stem.

3. The method of claim 2, wherein the angle defined between the actuators of the pair of actuators changes in response to a force having a component in a vertical direction and applied to an actuator of the pair of actuators near an end of the actuator distant from the valve stem.

4. The method of claim 2 wherein, the method further comprises a step of providing a valve stem connected to the reservoir, and the step of continually controlling includes a step of selectively engaging and disengaging the valve stem by pivotal movement of both actuators of the pair of actuators relative to the valve stem.

5. The method of claim 1, wherein the step of continuously controlling includes, at least, releasing the pressurized breathable gas from the reservoir in response to a change in position of either actuator of the pair of actuators relative to the other actuator of the pair of actuators.

6. The method of claim 5, wherein the step of continuously controlling further includes, at least, causing pivotal movement of one actuator of the pair of actuators in response to pivotal movement of the other actuator of the pair of actuators.

7. The method of claim 1, wherein the step of continuously controlling includes, at least, resisting decreases to the angle defined between the pair of actuators.

8. The method of claim 1, wherein the method further includes, at least, providing an exhaust port rigidly-defined beside an actuator of the pair of actuators, providing an exhaust flap covering the exhaust port, directing exhaled gases through the exhaust port, and flexing the exhaust flap to open the exhaust port in response to a difference in pressure across the exhaust flap created, in part, by exhaled gases.

9. The method of claim 1, wherein the step of channeling includes, at least, the steps of providing a biasing member at a location within the mouthpiece and between the pair of actuators,and filtering the pressurized breathable gas with the biasing member.

10. A breathing apparatus comprising:

a mouthpiece defining a bore therethrough;

a first actuator having a first end and a second end, said first actuator extending through said bore and said second end of said first actuator protruding from said bore;

a second actuator having a first end and a second end, said second actuator extending through said bore beneath said first actuator and said second end of said second actuator protruding from said bore;

a reservoir containing a breathable gas under pressure; and an interface member connected to and in fluid communication between said mouthpiece and said reservoir, said interface member including a valve operable by either of said first actuator and/or said second actuator;

whereby a user receives breathable gas through the mouthpiece and interface member from the gas reservoir by operating either of the first and/or second actuators with a biting motion to actuate the valve.

11. The breathing apparatus of claim 10, wherein said first actuator is positioned relative to said second actuator in an orientation which enables operation of said valve by either of said first actuator and said second actuator.

12. The breathing apparatus of claim 11 wherein, said first actuator includes a first face and a second face opposed to said first face, and said second actuator includes a face abutting said second face of said first actuator.

13. The breathing apparatus of claim 12, wherein said valve has a stem extending toward and engaging said first face of said first actuator.

14. The breathing apparatus of claim 11, wherein, said first actuator is pivotally connected to said interface member and engageable; with said valve, and said second actuator is pivotally connected to said interface member and engageable with said first actuator.

15. The breathing apparatus of claim 14, further including a biasing member extending between said first actuator and said second actuator, said biasing member contacting said first actuator and said second actuator at a location within said bore of said mouthpiece.

16. The breathing apparatus of claim 14, further including a filter element residing within said bore of said mouthpiece between said first actuator and said second actuator.

17. The breathing apparatus of claim 14 wherein, said interface member includes a pair of protruding members extending toward said bore of said mouthpiece and defining a passageway therebetween, one of said pair of protruding members opposing the other of said pair of protruding members, and said first actuator and said second actuator extend into said passageway.

18. The breathing apparatus of claim 17, wherein said first actuator connects to said protruding members at a location having elevation above and farther from said mouthpiece than a location where said second actuator connects to said protruding members.

19. The breathing apparatus of claim 18 wherein, said interface member defines a bore having an opening accessible between said pair of protruding members, said valve residing substantially within said bore of said interface member and having a stem protruding between said protruding members into said passageway, and said first end of said first actuator is adjacent said stem of said valve.

20. The breathing apparatus of claim 17, wherein said interface member has a wall and defines a portal extending through said wall adjacent one of said pair of protruding members.

21. The breathing apparatus of claim 20, wherein said breathing apparatus further includes a flexible flap adjacent to and occluding said portal.

22. The breathing apparatus of claim 20 wherein, said interface member defines a bore having an opening accessible between said pair of protruding members, said portal is a first portal, and said interface member further defines a second portal adjacent the other of said pair of protruding members, said second portal extending through said wall of said interface member.

23. The breathing apparatus of claim 10 wherein, said interface member defines a bore therein, said bore of said interface member having a first end and a second end below said first end, said breathing apparatus further includes a pressure indicator extending partially into said bore of said interface member at said first end of said bore, and said interface member connects to said reservoir at said second end of said bore.

24. The breathing apparatus of claim 10 wherein, said interface member has a wall, said wall defining a hole therethrough, and said breathing apparatus further includes a third actuator extending through said hole and into contact with one of said first and second actuators within said bore of said mouthpiece.

25. The breathing apparatus of claim 24 wherein, said third actuator includes a head located outside said interface member, and said breathing apparatus includes a biasing member extending between said head and said wall of said interface member.

26. The breathing apparatus of claim 24 wherein, said hole is a first hole and said wall defines a second hole therethrough, said second hole being diametrically opposed to said first hole, and said breathing apparatus further includes a fourth actuator extending through said second hole and into contact with the other of said first and second actuators within said bore of said mouthpiece.

27. The breathing apparatus of claim 10 wherein, said interface member defines a bore therein, said bore of said interface member having a first end and a second end below said first end, said reservoir includes a valve protruding therefrom, said valve of said reservoir extending into said bore at said second end, and said interface member further includes an adjuster positioned within said bore of said interface member and in contact with said valve of said reservoir.

28. The breathing apparatus of claim 27, wherein said adjuster defines a first portion and a second portion of said bore of said interface member, said first portion extending between said adjuster and said valve of said reservoir.

29. The breathing apparatus of claim 28, wherein said adjuster defines a passageway therethrough, said passageway extending between said first and second portions of said bore of said interface member.

30. The breathing apparatus of claim 29, wherein said adjuster has a first end in contact with said valve of said reservoir and a second end facing said first end of said bore of said interface member, said second end of said adjuster defining a slot therein.

31. A breathing apparatus comprising:

a reservoir containing a pressurized breathable gas;

a mouthpiece;

a control means for controllably releasing said breathable gas from said reservoir in response to a biting motion, said control means including a first actuator and a second actuator defining an angle therebetween, said first and second actuators protruding into said mouthpiece, a valve means for releasing breathable gas from said reservoir, said valve means including a valve operator, and a biasing means for resisting a reduction in the size of said angle and for filtering said breathable gas, said biasing means residing within said mouthpiece between said first and second actuators; and a reduction means for decreasing the pressure and velocity of said breathable gas released from said reservoir, said reduction means including only stationary parts and being connected between said control means and said reservoir;

wherein said first actuator is pivotally mounted relative to said valve operator and said first actuator pivotally engages said valve operator; and wherein said control means enables continual control over the release of said breathable gas from said reservoir.

* * * * *